United States Patent [19]

Lina

[11] Patent Number: 4,966,313

[45] Date of Patent: Oct. 30, 1990

[54] DEVICE ENABLING A SPRAY VALVE TO BE USED IN ANY POSITION

[75] Inventor: Jean-Pierre Lina, Neubourg, France

[73] Assignee: Societe Anonyme dite : VALOIS, Le Neubourg, France

[21] Appl. No.: 315,658

[22] Filed: Feb. 27, 1989

[30] Foreign Application Priority Data

Feb. 26, 1988 [FR] France ..... 88 02351

[51] Int. Cl.[5] ..... B65D 83/14

[52] U.S. Cl. ..... 222/402.19; 222/402.1

[58] Field of Search ..... 222/382, 402.1, 402.19

[56] References Cited

U.S. PATENT DOCUMENTS

| | | | |
|---|---|---|---|
| 3,447,551 | 6/1969 | Braun | 222/402.19 |
| 4,277,001 | 7/1981 | Nozawa | 222/402.19 |
| 4,775,079 | 10/1988 | Grothoff | 222/402.19 |
| 4,776,498 | 10/1988 | Maerte et al. | 222/402.19 |

FOREIGN PATENT DOCUMENTS

| | | | |
|---|---|---|---|
| 157352 | 8/1980 | Japan | 222/402.19 |

*Primary Examiner*—H. Grant Skaggs
*Assistant Examiner*—Steve Reiss
*Attorney, Agent, or Firm*—Sughrue, Mion, Zinn, Macpeak & Seas

[57] ABSTRACT

A device for enabling an aerosol valve designed to be crimped in the neck of a can to operate both upside-down and the rightway up, the device being designed to be placed between the inlet end fitting of the valve and a dip tube, and comprising two chambers (11, 12) in series and aligned on the axis of the valve. The chambers are interconnected by a channel (13) having an opening into each of said chambers, and also being in communication with the suction zone (17) of the valve. Each chamber includes a gravity-operated non-return valve member for engaging the corresponding channel opening, with each non-return valve member occupying a closed position when the corresponding channel opening is in the bottom of the corresponding chamber. The chamber which is closer to the valve (1) is also in communication with a zone (18) outside the valve and close to the valve via the end of the chamber which is opposite to its channel opening. The chamber (12) which is further from the valve (1) is also in communication with said dip tube (3) via its end which is opposite to its channel opening. The device is constituted by three generally tubular parts mounted concentrically, namely: an outer sleeve (12) suitable for receiving the valve body; a tubular part (4) for engaging on the inlet end fitting of the valve; and a central bush (5) including the channel (13) and defining said chambers in conjunction with the tubular part.

6 Claims, 2 Drawing Sheets

DEVICE ENABLING A SPRAY VALVE TO BE USED IN ANY POSITION

The present invention relates to spray valves of the type which are mounted in the opening of a receptacle such as an aerosol can or a flask in order to extract the contents thereof and project it as a spray. The term "valve" is used herein to cover both hand-actuated pump systems and systems that make use of a propellant gas received in the receptacle, with the gas being optionally soluble in the liquid to be sprayed. The invention seeks to provide a device enabling a valve that is designed to operate in one position only (the rightway up) to operate in any position, i.e. to enable a spray to be used the rightway up or upsidedown. In accordance with an advantageous feature of the invention, the device is particularly adapted to valves designed to be mounted on receptacles having narrow openings. The device of the invention is particularly suitable for use with pump systems actuated by the finger of the user.

BACKGROUND OF THE INVENTION

Japanese patent No. 55-157 352 describes a device for enabling an aerosol valve designed to be crimped in the neck of a can to operate both upsidedown and the rightway up, said device being designed to be placed between the inlet end fitting of the valve and a dip tube, and comprising two chambers in series and aligned on the axis of the valve, said chambers being interconnected by a channel having an opening into each of said chambers, said channel also being in communication with the suction zone of the valve, each chamber including a gravity-operated non-return valve member for engaging the corresponding channel opening, each non-return valve member occupying a closed position when the corresponding channel opening is in the bottom of the corresponding chamber, the chamber which is closer to the valve also being in communication with a zone outside the valve and close to the valve via the end of the chamber which is opposite to its channel opening, and the chamber which is further from the valve also being in communication with said dip tube via its end which is opposite to its channel opening. Such a device makes advantageous applications possible, but it is difficult to manufacture and assemble.

The object of the present invention is to provide an advantageous structure which is simplified for the manufacture of such a device.

SUMMARY OF THE INVENTION

The present invention provides a device of the kind defined above and further comprising three generally tubular parts mounted concentrically, namely: an outer sleeve suitable for receiving the valve body; a tubular part for engaging on the inlet end fitting of the valve; and a central bush including said channel and defining said chambers in conjunction with said tubular part. Advantageously, the bush includes a portion which is molded to be wider than the width it occupies when mounted in the device, with said portion being urged together during assembly of the device by the bush being inserted into the tubular part, with said urging causing one of the chambers to be closed. This disposition makes it possible to insert a ball into the chamber prior to closing said chamber by inserting it fully into its positin in the bush inside the tubular part.

BRIEF DESCRIPTION OF THE DRAWINGS

An embodiment of the invention is described by way of example with reference to the accompanying drawings, in which.

DETAILED DESCRIPTION

Figure 1:
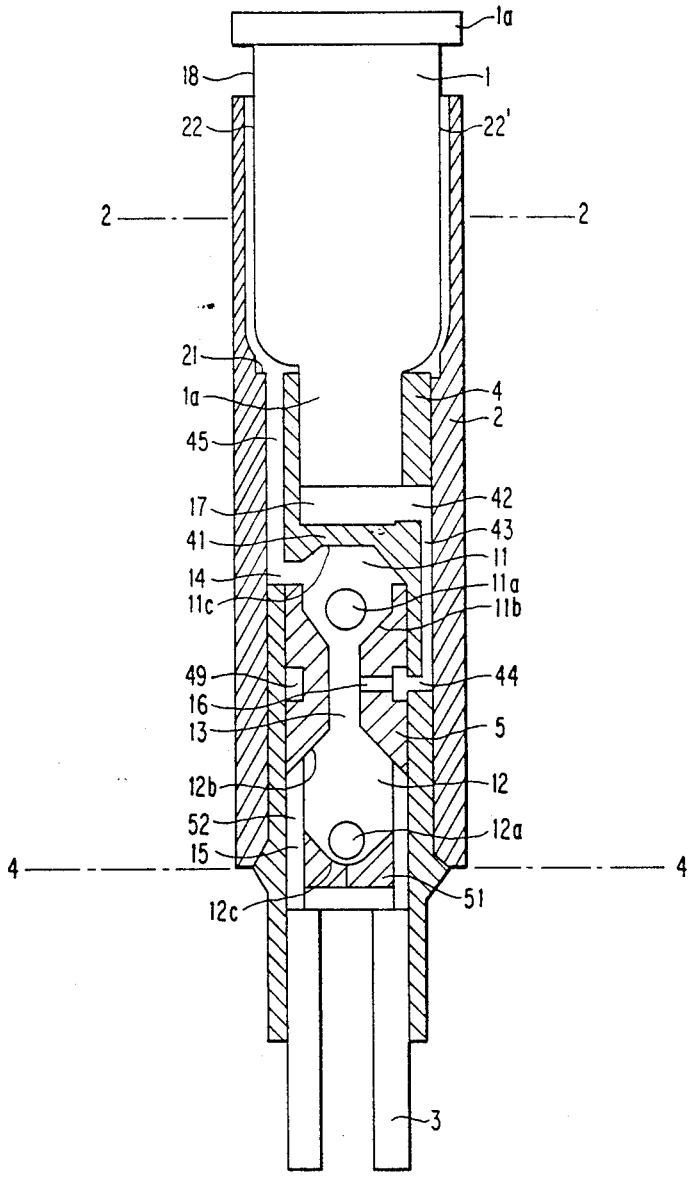
FIG. 1 is a section view through a device in accordance with the invention and fitted on an ordinary valve which is normally designed to operate only when the rightway up.

In the example shown, the device is fitted on a valve 1 by means of a sleeve 2. The valve is intended to be fitted in conventional manner in the neck of a receptacle (not shown) by means of a capsule crimped to the rim 1*a* of the valve. The valve may be of any type: pump; on/off; metering, or otherwise. In this example it is a valve which is generally tubular in shape and which has a small diameter enabling it to be inserted in the necks of narrow-necked cans or flasks. The invention is applicable to any type of valve, regardless of whether it is narrow or not, however it is particularly advantageous for use with narrow valves.

Inside the sleeve 2 and lying on the axis of the valve 1, there are two chambers 11 and 12 connected to each other in series by a channel 13. Each chamber includes an additional opening at its end opposite to its channel opening, with the chamber 11 having an opening 14, and the chamber 12 having an opening 15. Each chamber receives a small ball 11*a* or 12*a* as the case may be acting as a non-return valve in conjunction with the corresponding channel opening 11*b* or 12*b*, with said channel openings constituting valve seats. The term "small" ball is used herein to mean a ball whose diameter is substantially less than 4 mm, e.g. about 2 mm or less. In general, the balls that have been used heretofore to constitute non-return valves in such spray valves have been not less than 4 mm in diameter, since otherwise such balls run the risk of being entrained by the fluid flow and thus being pressed against their seats. As explained below, chambers shaped in accordance with the invention make it possible to make use of small balls. An orifice 16 is formed in the middle of the channel 13 and is in communication with the inlet 17 (or suction zone) of the valve 1.

The opening 14 in the chamber 11, i.e. the opening closer to the valve, is in communication with an internal zone 18 of the receptacle close to its neck (and at the top when the receptacle is standing upright while not in use) and the opening 15 is in communication with the dip tube 3.

Operation: when the valve is the rightway up, the ball 12*a* rests in the bottom of its chamber so the opening 12*b* is open, whereas the ball 11*a* rests on its seat 11*b*. The opening 11*b* is therefore closed. In this position, the inside of the dip tube 3 is in communication with the inlet zone 17 of the valve 1. If the valve is operated, the substance contained in the can may flow along the dip tube and rise by pressure or suction to the opening 15 into the chamber 12, after which it passes via the channel 13 and the orifice 16 into the suction 3 one of the valve 1 which can therefore operate normally without being capable of pressing the ball 12*a* against its seat 12, in spite of the small diameter of the ball, by virture of the disposition of the passages. The region 18 which is close to the top of the can when in this position, contains a gaseous atmosphere. This region is in communication with chamber 11, but the bottom of the chamber 11 is closed by the non-return valve constituted by the ball 11*a* resting on its seat 11*b*. If the inside of the can is under pressure by virtue of a propellant fluid, then this pressure presses against the non-return valve 11*a* and keeps it closed. If the inside of the can is not under pressure, then it is suction from the valve which keeps the non-returned valve closed.

If the device is made to operate in the upsidedown position, then the region 18 is filled with substance to be sprayed via the valve while the end of the dip tube is in a gaseous atmosphere. Since the valve is upsidedown, non-return valve 12*a* and 12*b* is closed and non-return valve 11*a*, 11*b* is open, and as a result the device again operates in the desired manner.

The device is remarkable in particular for its small dimensions, with the entire assembly lying on the same axis as the valve and being received in the sleeve 2 which is of substantially the same diameter as the valve and may be very thin. That is why it is necessary to use small-diameter balls. Such balls may be entrained by the fluid flow and be pressed against their seats, thereby interrupting spraying. In order to avoid this drawback, the invention is designed so that the balls are not placed in a flow of moving fluid. To make this possible, each of the chambers 11 and 12 is formed with a cup 11*c* and 12*c* at its end opposite to its inlet to the channel 13. Under such conditions, gravity causes one of the balls to close its non-return valve and the other ball to rest in its cup away from the flow of fluid which could lift it up and press it against its seat.

The invention provides means for enabling industrial manufacture of the device to be performed under economically favorable conditions.

Figure 2:
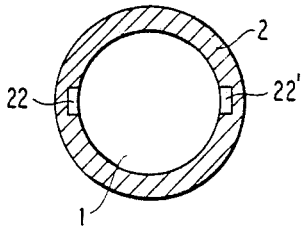
FIG. 2 is a section view on line II—II of FIG. 1.

Apart from the valve 1 and the dip tube 3, the device of the invention comprises the two balls and three parts made of molded plastics material. A first part is constituted by the sleeve 2 in which the valve is engaged. A circular chamber 21 is provided in the sleeve at a level corresponding with the base on the valve, and an internal groove 22 runs from the circular chamber 21 to the end of the sleeve in order to provide communication with the inside volume 18 of the can, outside the valve. It can be seen from the section of FIG. 2, that two such grooves 22 and 22' are provided.

A tubular part 4 is received inside the sleeve 2 and is threaded over the end piece 1*a* of the valve 1 instead of and in the place of an external dip tube. This part has a transverse partition 41 separating a volume containing the valve from a volume containing the non-return chambers. The partition 41 is situated at a distance from the end of said tubular part 4 which is slightly greater than the length of the end piece 1*a* of the valve 1. The partition 41 and the end of the valve's end piece together define the inlet or suction zone 17 of the valve 1. Level with this zone, the tubular part 4 is formed with an opening 42 putting the inside of the part, i.e. the zone 17, into communication with the outside where a longitudinal groove 43 is formed extending to a further opening 44 level with the orifice 16 opening out into the channel 13 between the two chambers. The tubular part 4 includes another longitudinal groove 45 extending from the top end of the part to the level of the chamber 11, with which it communicates via an opening 14. This provides communication between the chamber 11 and the zone 18 outside the valve via the opening 14, the groove 45, and annular chamber 21 formed in the sleeve 2, and the grooves 22 and 22'. Naturally, there is no need for the groove 45 to lie in the same plane as the groove 22. The annular chamber 21 ensures that the relatives orientations of the parts 2 and 4 are immaterial.

Finally, the device includes a bush 5. The bush has a main portion defining the channel 13 and the two valve seats 11*b* and 12*b*. Valve seat 11*b* and partition 41 in the tubular part define the chamber 11. Valve seat 12*b* and a secondary portion 51 of the bush 5 define the chamber 12. The main portion of the bush 5 is formed with a circular groove 49 into which the orifice 16 opens out, as does the opening 44. By virtue of this circular groove, the relative orientations of the bush 5 and the tubular part 4 are immaterial. There is no need for the groove 43 and the opening 44 to lie in the same plane as the orifice 16. This configuration is shwon mearly to facilitate understanding the drawing.

Figure 3:
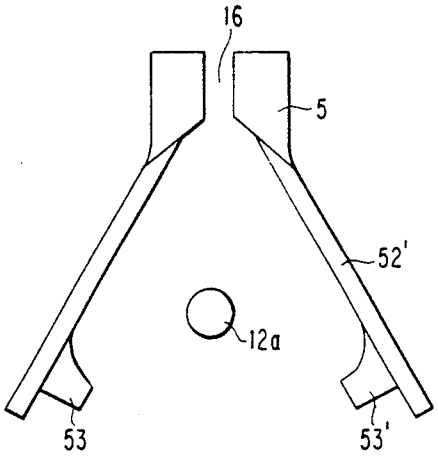
FIG. 3 is a view on a larger scale showing a detail of a part of the device shown in FIG. 1 prior to being assembled with the other parts of the device.

The secondary portion 51 of the bush comprises a cup 12*c* connected to the main portion thereof via at least one arm 52. Preferably, the cup is constituted by a plurality of at least two and advantageously three or four portions 53 and 53' constituting sectors, with each sector being held by a corresponding arm 52, 52'. This portion of the bush 5 is molded in the shape shown in FIG. 3. The arms 52 move towards one another and the sectors 53, 53' are pressed together in order to constitute the cup 51 by inserting the bush into the tube 4, while nevertheless leaving the chamber 12 in communication with the dip tube 3 via spaces left between the arms 52, 52'. Thus, during assembly, it suffices merely to insert the ball 12*a* at the right moment prior to the cup 51 being closed. The ends of the arms 52, 52' extend beyond the sectors 53, 53' and serve as abutments for the dip tube 3 in order to allow fluid to pass around the cup 51. It would be possible to mold the cup as a single piece on an end of a single arm 52, however this disposition does not appear to facilitate the operations of assembling and mounting the device.

Figure 4:
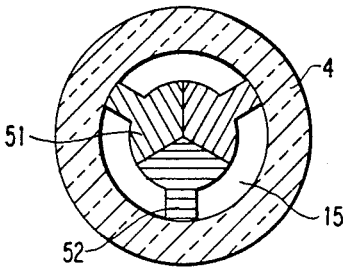
FIG. 4 is a section view on line IV—IV of FIG. 1.

FIG. 4 clearly shows three portions of the cup 51 together with the corresponding arm 52. The arms leave passages 15 between one another and they are surrounded by the tubular part 4.

I claim:

1. A device for enabling an aerosol valve designed to be crimped in the neck of a can to operate both upsidedown and the rightway up, said device being designed to be placed between the inlet end fitting of the valve and a dip tube, and comprising two chambers in series and aligned on the axis of the valve, said chambers being interconnected by a channel having an opening into each of said chambers, said channel also being in communication with the suction zone of the valve, each chamber including a gravity-operated non-return valve member for engaging the corresponding channel opening, each non-return valve member occupying a closed position when the corresponding channel opening is in the bottom of the corresponding chamber, the chamber which is closer to the valve also being in communication with a zone outside the valve and close to the valve via the end of the chamber which is opposite to its channel opening and the chamber which is further from the valve also being in communication with said dip tube via its end which is opposite to its channel opening, wherein said device comprises three generally tubular parts mounted concentrically, namely: an outer sleeve suitable for receiving the valve body; a tubular part for engaging on the inlet end fitting of the valve; and a central bush including said channel and defining said chambers in conjunction with said tubular part.

2. A device according to claim 1, wherein the bush includes a portion which is molded in divided form with spread apart elements to be wider than the width it occupies when mounted in the device, with said spread apart elements being urged together during assembly of the device by the bush being inserted into the tubular part with said urging causing one of the chambers to be partially closed by engagement of said spread apart elements.

3. A device according to claim 2, wherein the non-return valve members are constituted by balls of small diameter, about 2 mm or less.

4. A device according to claim 2, wherein each chamber includes a cup at its end opposite to its opening to said channel, with the fluid inlet opening into each chamber being located between said cup and the outlet opening from the chamber into the channel so that during operation of the device, in either position, the valve member in the lower chamber is not exposed to the flow of aerosol.

5. A device according to claim 1, wherein the non-return valve members are constituted by balls of small diameter, about 2 mm or less.

6. A device according to claim 1, wherein said each chamber includes a cup at its end opposite to its opening to said channel, with the fluid inlet opening into each chamber being located between said cup and the outlet opening from the chamber into the channel.

* * * * *